US006626663B1

(12) United States Patent
Zhu

(10) Patent No.: US 6,626,663 B1
(45) Date of Patent: Sep. 30, 2003

(54) PROCESSES FOR REDISTRIBUTING HEAT FLUX ON PROCESS TUBES WITHIN PROCESS HEATERS, AND PROCESS HEATERS INCLUDING THE SAME

(75) Inventor: Naiping Zhu, Strongsville, OH (US)

(73) Assignee: Fosbal Intellectual AG, Pfaffikon (CH)

( * ) Notice: Subject to any disclaimer, the term of this patent is extended or adjusted under 35 U.S.C. 154(b) by 0 days.

(21) Appl. No.: 10/219,934

(22) Filed: Aug. 16, 2002

(51) Int. Cl.[7] ..... F27B 19/00
(52) U.S. Cl. ..... 432/120; 432/266
(58) Field of Search ..... 432/120, 236, 432/246, 4, 266; 122/367.1

(56) References Cited

U.S. PATENT DOCUMENTS

| | | | | |
|---|---|---|---|---|
| 4,617,870 A | * | 10/1986 | Hirano et al. | 110/323 |
| 6,095,097 A | * | 8/2000 | Gibson et al. | 122/367.1 |
| 6,158,396 A | * | 12/2000 | Lackstrom et al. | 122/367.3 |
| 6,186,410 B1 | | 2/2001 | Mercier et al. | |
| 6,253,715 B1 | * | 7/2001 | Takubo et al. | 122/235.11 |
| 6,561,797 B1 | * | 5/2003 | Johnson | 432/225 |

OTHER PUBLICATIONS

The Fosbel Process, Ceramic Welding, The only durable hot repair method for glass furnaces; Fosbel Ceramic Technologies.

Preventative maintenance; The positive approach to ending intermediate repairs; Fosbel Ceramic Technologies.

Aluminum furnace repair without shutdown; Fosbel Ceramic Technologies.

Sprayed–on ceramic coatings increase furnace life and efficiency; Energy Management Technology, Mar. 1986, pp. 34–37.

Ceramic Welding; Refractory Renewal Without Shutdown; Fosbel Ceramic Technologies.

Ceramic Industry; The exclusive Global Voice of Ceramic Business & Manufacturing; Ceramic Welding: Performance by Design by Kevin Pendleton.

High emissivity coatings—their effects on efficiency improvement in olefin process heaters by Michael Ennis, Cetek Limited, New South Wales, Australia; Cetek Ceramic Technologies.

* cited by examiner

*Primary Examiner*—Jiping Lu
(74) *Attorney, Agent, or Firm*—Nixon & Vanderhye P.C.

(57) ABSTRACT

Process tubes of a fired process heaters are provided with a more equal heat flux distribution about an exterior circumferential surface region thereof. More specifically, according to the present invention, there is provided on at least one circumferential segment of the exterior circumferential surface region of the process tube, a coating of a material having a selected thermal emissivity and/or thermal conductivity which is different from the thermal emissivity and/or thermal conductivity of another circumferential segment of the exterior circumferential surface of the process tube. In such a manner, a more equal heat flux distribution about an entirety of the exterior circumferential surface region of the process tube is established as compared to the heat flux distribution thereabout in the absence of the coating.

22 Claims, 2 Drawing Sheets

Figure 1:
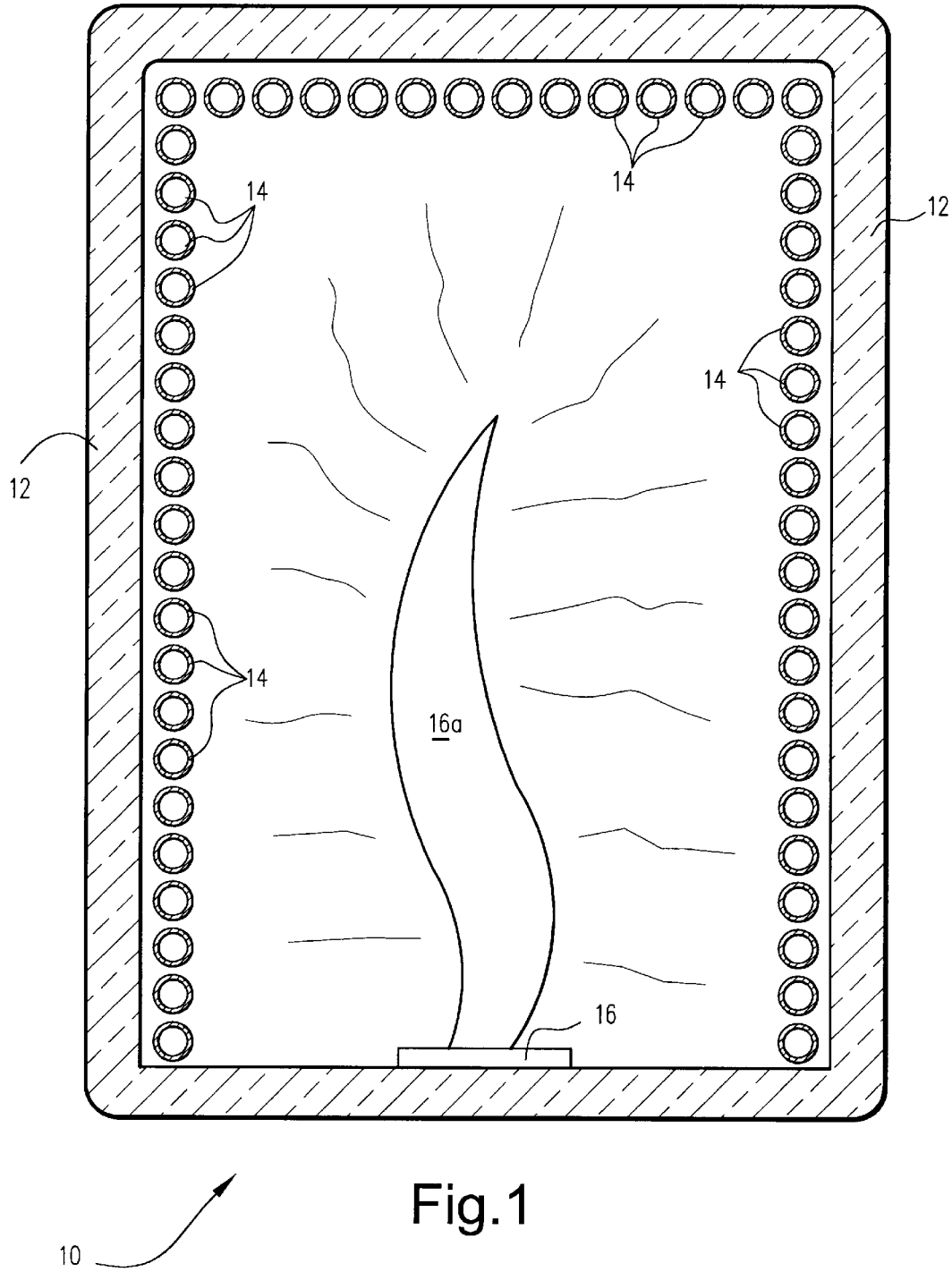

PROCESSES FOR REDISTRIBUTING HEAT FLUX ON PROCESS TUBES WITHIN PROCESS HEATERS, AND PROCESS HEATERS INCLUDING THE SAME

FIELD OF THE INVENTION

The present invention relates generally to methods whereby heat fluxes on process tubes within process heaters may be manipulated so as to be more equal circumferentially. The methods of the invention are especially well suited for use in coke sensitive fired heaters employed in the petroleum refining industry, such as coker units, vacuum units, crude heaters, and the like.

BACKGROUND AND SUMMARY OF THE INVENTION

Most coker sensitive heaters or furnaces, such as coker, vacuum and crude heaters, are so-called single fired units which employ a source of combustion generally centrally of an array of process tubes. The process tubes are thus typically positioned closely adjacent the refractory wall of the heater which results in uneven circumferential heat flux distribution. That is, circumferential segments of the tube adjacent the combustion element of the heater is typically hotter than the circumferential segment of the tube adjacent the refractory wall of the process vessel.

The heat flux on the hotter fired side of the tube results in higher tube metal temperature as compared to the refractory wall side of the tube. A higher coking deposition rate internally of the tube at the hotter fired side thereof is the net result of such uneven circumferential heat flux deposition. Such unequal internal circumferential coking also leads to premature disadvantageously high pressure drop through the tube and/or a disadvantageously high temperature at the exterior surface of the tube (i.e., since the coking on the internal tube surface acts as an insulator). Consequently, reduced operational run lengths for the fired heaters ensue. For example, a typical coker unit requires decoking every six to nine months, with some coker units requiring decoking every three months.

There is also unequal heat fluxes which exist within the process heater itself which can result in relatively uneven coking from one tube section to another. Thus, some tubes or tube sections may be closer to the combustion source as compared to other tubes or tube sections within the process heater. Those tubes more remote from the combustion source (e.g., those tubes near the top of the heater when the combustion source is at the heater bottom) may have circumferential segments of the tube which exhibit a lesser heat flux as compared to similar circumferential segments of tubes closer to the combustion source even though the circumferential segments are oriented so as to face the heat generated by the combustion source.

It would therefore be highly desirable if process tubes or tube segments within fired vessels could be imparted with a more uniform circumferential heat flux distribution. It would also be desirable if heat flux within the process heater could be more equally redistributed by virtue of providing different tubes and/or tube sections with predetermined different, but locally substantially uniform, circumferential heat flux distribution. It is therefore towards fulfilling such needs that the present invention is directed.

Broadly, the present invention is directed toward methods for providing more equal heat flux distribution about an exterior circumferential surface of at least one section of a process tube within a process heater, and to such process tubes on which a more equal circumferential heat flux distribution has been imparted. More specifically, according to the present invention, there is provided on at least one circumferential segment of at least one exterior circumferential surface section of the process tube, a coating of a material having a selected thermal emissivity and/or thermal conductivity which is different from the thermal emissivity and/or thermal conductivity of another circumferential segment of the same exterior circumferential surface section of the process tube. In such a manner, a more equal thermal conductance about an entirety of the exterior circumferential surface section of the process tube is established as compared to the thermal conductance thereabout in the absence of the coating, thereby resulting in a more equal heat flux distribution circumferentially on the tube section.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein;

FIG. 1 is a cross-sectional schematic view of a single fired coker unit having process tubes in accordance with the present invention; and FIGS. 2A–2D are enlarged cross-sectional schematic views of one presently preferred technique to impart a more uniform circumferential heat flux distribution to process pipes in accordance with the present invention.

DETAILED DESCRIPTION OF THE INVENTION

Accompanying FIG. 1 depicts schematically a fired process heater 10, such as a single fired coker unit. In this regard, the heater 10 includes refractory walls 12 for purpose of minimizing heat loss from the vessel, and a number of process tubes (a few of which are identified by reference numeral 14) arranged adjacent to the walls 12. A heater unit 16 is provided so as to provide a source of heat as schematically shown by flame 16*a*. Thus, as can be seen from FIG. 1, that portion of the tubes 14 which is directly exposed to the flame 16*a* is hotter as compared to that portion of the tubes 14 which are immediately adjacent the refractory wall 12 thereby leading to the problems discussed briefly above.

Figures 2A, 2B, 2C, 2D:
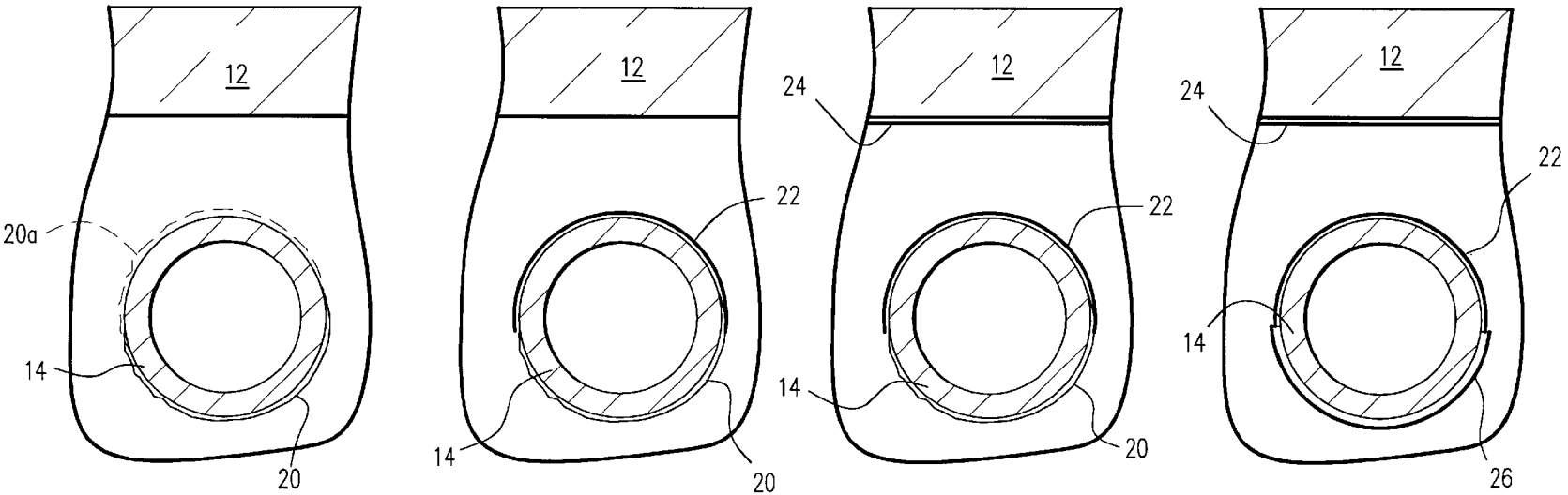

Accompanying FIGS. 2A–2D depict schematically preferred techniques in accordance with the present invention so as to impart a more uniform circumferential heat flux distribution to the tubes 14. In this regard, as shown in FIG. 2A, a representative process tube 14 is shown with a circumferential scale deposit 20 on its exterior surface. The scale 20 can of course itself provide decreased heat flux. Thus, according to the present invention, a circumferential region (noted by the dashed line representation and reference numeral 20*a*) of the scale deposit 20 may be removed from the tube 14 adjacent the refractory wall 12. Removal of the scale deposit 20*a* may be accomplished via any suitable technique. For example, the sand blasting technique described in commonly owned copending U.S. patent application Ser. No. 10/219,943 filed even date herewith (Atty. Dkt. No. 889-9) (the entire content of which is expressly incorporated hereinto by reference) may be employed so as to selectively remove the circumferential region of scale deposit 20*a* and thereby expose the bare metal of the underlying tube 14.

With the circumferential region of scale deposit 20*a* removed, a coating 22 may be applied as shown in FIG. 2B. In this regard, the coating 22 is a material which is selected for its emissivity and/or thermal conductivity properties so as to achieve a desired thermal conductance (e.g., in terms of heat transfer per unit area through the tube wall) about the entire circumferential surface region of the tube 14.

As used herein, the emissivity (E) of a material is meant to refer to a unitless number measured on a scale between zero (total energy reflection) and 1.0 (a perfect "black body" capable of total energy absorption and re-radiation). According to the present invention, a relatively high emissivity (E) is meant to refer to coating materials having an emissivity of greater than about 0.80, and usually between about 0.90 to about 0.98. Relatively low emissivity is therefore meant to refer to coating materials having an emissivity of less than about 0.80, usually less than about 0.75 (e.g., between about 0.15 to about 0.75). Low emissivities of between about 0.45 to about 0.75 may likewise be employed. Thus, the range of emissivities of coating materials that may be employed in the practice of the present invention can be from about 0.15 to about 0.98 and will depend upon the specific requirements needed for a specified process vessel.

As can be appreciated, the scale deposit 20 will exhibit a relatively low thermal conductivity, but relatively high emissivity. As such, the coating 22 is selected so as to essentially provide a more uniform heat flux about the entire circumference of the tube 14. Thus, the differences in the emissivity and/or thermal conductivity of one circumferential region of the tube 14 as compared to another circumferential region (e.g., as between the region of the scale deposit 20 and the coating 22) is such that the entire circumferential heat flux (thermal conductance) is rendered on average more uniform when consideration is given to the fact that one region may be more hot in use as compared to another region (i.e., is subjected to differential thermal conditions in use). In practice, it is preferred that the emissivity differences of one circumferential region of the tube 14 as compared to another circumferential region of the tube be at least about 5%, and typically at least about 10% or more (e.g., an emissivity difference of between about 15% to about 50%).

It will be appreciated that, within the desired goal to impart a more uniform heat flux about the entire circumference of the tube 14 and/or to provide a more uniform heat flux within the process heater environment per se, a variety of techniques may be employed. For example, a relatively high-E or low-E coating 24 may be applied additionally onto the refractory wall 12 adjacent the coating 22 as shown in FIG. 2C, or may be applied alternatively instead of the coating 22. Additionally (or alternatively), the scale 20 may be removed and a coating 26 possessing desired emissivity and/or conductivity properties may be applied on the hot side of the tube 14 as shown in FIG. 2D.

It will be appreciated that within the environment of the process heater 10, it may be necessary to provide one or more tubes and/or longitudinal tube sections which exhibit a different heat flux as compared to one or more other tubes and/or tube sections within the heater 10. Individually, however, such tubes and/or tube sections will each most preferably exhibit substantially uniform heat flux circumferentially in accordance with the present invention as has been described previously. However, by providing preselected different circumferential heat fluxes of tubes and/or tube sections which are nonetheless individually substantially uniform will allow the heat flux within the environment of heater 10 to be more evenly redistributed.

Coating thicknesses on the tubes are not critical but will vary in dependence upon the desired resulting thermal flux and/or the particular material forming the coating. Thus, coating thicknesses of from about 1 to about 60 mils may be appropriate for a given tube application, with coating densities typically being greater than about 75%, more specifically 90% or greater.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for providing more equal heat flux distribution about an exterior circumferential surface region of a process tube within a fired process vessel which comprises providing, on at least one circumferential segment of the exterior circumferential surface region of the process tube, a coating of a material having a selected thermal emissivity and/or thermal conductivity which is different from the thermal emissivity and/or thermal conductivity of another circumferential segment of the exterior circumferential surface region of the process tube to thereby impart a more equal heat flux distribution about an entirety of the exterior circumferential surface region of the process tube as compared to the heat flux distribution thereabout in the absence of the coating.

2. The method of claim 1, wherein the emissivity difference is at least 5% between said at least one circumferential segment and said another circumferential segment.

3. The method of claim 2, wherein the emissivity difference is at least about 10%.

4. The method of claim 1, wherein said at least one circumferential segment has a coating which exhibits a high emissivity of at least about 0.80.

5. The method of claim 1, wherein said at least one circumferential segment has a coating which exhibits a low emissivity of less than about 0.80.

6. The method of claim 1, wherein said at least one and said another circumferential surfaces are coated with respective materials having an emissivity of between about 0.15 to about 0.98, provided that the emissivity of said respective materials differs by at least about 5%.

7. The method of claim 6, wherein the emissivity difference is at least about 10%.

8. The method of claim 1, wherein said at least one circumferential segment is coated with a material having a relatively high emissivity of about 0.80 or greater, and wherein said another circumferential segment is coated with a material having a relatively low emissivity of less than about 0.80, provided that said relatively high and low emissivities differ by about 5%.

9. The method of claim 8, wherein said relatively high and low emissivities differ by about 10%.

10. A process tube for a process heater having a generally uniform circumferential heat flux provided by a method according to any one of claims 1–9.

11. A process tube for a process heater which exhibits a more equal heat flux distribution about an exterior circumferential surface region thereof which comprises, on at least one circumferential segment of the exterior circumferential surface region of the process tube, a coating of a material having a selected thermal emissivity and/or thermal conductivity which is different from the thermal emissivity and/or thermal conductivity of another circumferential segment of the exterior circumferential surface region of the process tube to thereby impart a more equal heat flux distribution about an entirety of the exterior circumferential surface region of the process tube as compared to the heat flux distribution thereabout in the absence of the coating.

12. The process tube of claim 11, wherein the emissivity difference is at least 5% between said at least one circumferential segment and said another circumferential segment.

13. The process tube of claim 12, wherein the emissivity difference is at least about 10%.

14. The process tube of claim 11, wherein said at least one circumferential segment has a coating which exhibits a high emissivity of at least about 0.80.

15. The process tube of claim 11, wherein said at least one circumferential segment has a coating which exhibits a low emissivity of less than about 0.80.

16. The process tube of claim 11, wherein said at least one and said another circumferential surfaces are coated with respective materials having an emissivity of between about 0.15 to about 0.98, provided that the emissivity of said respective materials differs by at least about 5%.

17. The process tube of claim 16, wherein the emissivity difference is at least about 10%.

18. The process tube of claim 11, wherein said at least one circumferential segment is coated with a material having a relatively high emissivity of about 0.80 or greater, and wherein said another circumferential segment is coated with a material having a relatively low emissivity of less than about 0.80, provided that said relatively high and low emissivities differ by about 5%.

19. The process tube of claim 18, wherein said relatively high and low emissivities differ by about 10%.

20. A process heater which includes at least one process tube of any one of claims 11–19.

21. The process heater of claim 20, which includes another said process tube having a different substantially uniform circumferential heat flux as compared to said at least one process tube.

22. The process heater as in claim 20, which comprises a refractory wall, and a coating having predetermined thermal emissivity and/or thermal conductivity properties on said refractory wall.

* * * * *

UNITED STATES PATENT AND TRADEMARK OFFICE

CERTIFICATE OF CORRECTION

PATENT NO. : 6,626,663 B1
DATED : September 30, 2003
INVENTOR(S) : Naiping Zhu

It is certified that error appears in the above-identified patent and that said Letters Patent is hereby corrected as shown below:

Title page,
Item [73], Assignee, should read:
-- [73] Assignee: Fosbel Intellectual AG, Pfaffikon (CH) --

Signed and Sealed this

Fourteenth Day of June, 2005

JON W. DUDAS
*Director of the United States Patent and Trademark Office*